United States Patent [19]

Kayl

[11] Patent Number: 4,785,911

[45] Date of Patent: Nov. 22, 1988

[54] SAWHORSE ROLLER ATTACHMENT

[76] Inventor: Dennis J. Kayl, R.R. 1, Box 22A, Burbank, S. Dak. 57010

[21] Appl. No.: 143,680

[22] Filed: Jan. 14, 1988

[51] Int. Cl.[4] ..... B25H 1/06; B27B 21/02

[52] U.S. Cl. ..... 182/129; 182/181; 182/224; 269/289 MR

[58] Field of Search ..... 182/129, 181–185, 182/224; 269/289 MR

[56] References Cited

U.S. PATENT DOCUMENTS

| | | | |
|---|---|---|---|
| 155,592 | 10/1874 | Sherman | 182/181 |
| 791,218 | 5/1905 | Sawhorse | 182/129 |
| 2,222,078 | 11/1940 | Kroeger | 182/129 |
| 2,653,347 | 9/1953 | Diekman | 269/289 MR |
| 4,039,064 | 8/1977 | Kirby | 269/289 MR |

FOREIGN PATENT DOCUMENTS

| | | | |
|---|---|---|---|
| 18495 | 11/1980 | European Pat. Off. | 269/289 MR |
| 105399 | 6/1898 | Fed. Rep. of Germany | 182/181 |
| 342729 | 10/1921 | Fed. Rep. of Germany | 182/181 |
| 216702 | 3/1924 | United Kingdom | 182/181 |

*Primary Examiner*—Reinaldo P. Machado
*Attorney, Agent, or Firm*—John A. Beehner

[57] ABSTRACT

The sawhorse roller attachment of the present invention includes an elongated roller and a pair of brackets adapted for securement to the top cross bar of a sawhorse for supporting the roller at a position wherein the top of the roller is disposed adjacent the plane of the top edge of the top cross bar. Each bracket has alternate first and second roller supports to accommodate attachment of the bracket to either an upright face of the top cross bar or to the underside of a generally horizontal top cross bar.

10 Claims, 1 Drawing Sheet

SAWHORSE ROLLER ATTACHMENT

BACKGROUND OF THE INVENTION

The present invention is directed generally to a roller attachment for any workpiece support member and more particularly to a roller adapted to be supported adjacent the top edge of a sawhorse cross bar so that when one end of a workpiece is manually lifted, the other end will freely roll on the roller.

When supporting large boards such as 4×8 plywood sheets on a pair of sawhorses, it is difficult to reposition the board because if the board is picked up at one end and pulled or pushed, it is likely the other sawhorse will simply tip over rather than allowing the heavy board to slide on the top surface of the sawhorse. Even if the sawhorse allows for some sliding movement of a board, the frictional engagement between the sawhorse and board can result in undesirable scratching of the board. This inventor has alleviated these problems by providing a simple roller than can be easily attached to one sawhorse of a pair by a couple of relatively simple brackets.

A roller for a sawhorse is disclosed in Schuyler, U.S. Pat. No. 791,218 issued in 1905 wherein the sawhorse top cross bar is channeled out to receive a roller which is mounted on bearing blocks to accommodate vertical adjustment on the roller to positions above and below the top face of the cross bar. The Schuyler invention is an integral part of a custom built sawhorse, which is not likely to be economically feasible for widespread usage.

Accordingly, a primary object of the invention is to provide an improved roller attachment for a workpiece support member.

Another object is to provide an improved roller attachment which may be readily mounted on a conventional sawhorse.

Another object is to provide an improved roller attachment having alternate roller supports to accommodate attachment to a 2×4 sawhorse top cross bar whether the nominal four inch sides are upright or horizontal.

Another object is to provide a sawhorse roller attachment which is readily and easily attached to any sawhorse cross bar or other workpiece support member.

Finally, an object of the invention is to provide an improved sawhorse roller attachment which is simple and rugged in construction, economical to manufacture and efficient in operation.

SUMMARY OF THE INVENTION

The roller attachment of the present invention includes an elongated roller and preferably two brackets for rotatably supporting opposite ends of the roller on the top cross bar of a sawhorse of any other workpiece support member. Each bracket includes an elongated fastening plate having interior and exterior faces and alternate first and second roller supports positioned interiorly of the fastening plate for supporting the roller for rotation about respective first and second axes extended parallel and transversely of the fastening plate.

It is contemplated that the top cross bar of the sawhorse or other workpiece support member is generally rectangular in cross section having opposite long and short sides. Accordingly, the first roller support on the bracket is arranged relative to the fastening plate for supporting the roller with the top of the roller adjacent the plane of the top edge of the workpiece support member upon positioning of the workpiece support member with the long sides upright and upon securement of the fastening plate to an upright long side with the exterior face of the fastening plate facing that long side. The second roller support of the bracket is arranged relative to the fastenig plate for supporting the roller with the top of the roller adjacent the plane fo the top edge of the workpiece support member upon positioning of the workpiece support member with the short sides upright and upon securement of the fastening plate to the long bottom side of the workpiece support member with the interior face of the fastening plate facing the long bottom side. Thus whether the workpiece support member is positioned with its long sides upright or horizontally disposed, a board or other workpiece overlying the workpiece support member may be supported on the roller for rolling movement relative to the workpiece support member without tipping over the sawhorse or otherwise scratching workpiece.

BRIEF DESCRIPTION OF THE DRAWINGS

FIG. 3 is an enlarged side sectional view showing the bracket of the invention secured to an upright long side of a workpiece support member; and FIG. 4 is an enlarged perspective view showing the bracket of the invention secured to the long horizontally disposed bottom side of a workpiece support member.

DESCRIPTION OF THE PREFERRED EMBODIMENT

Figure 1:
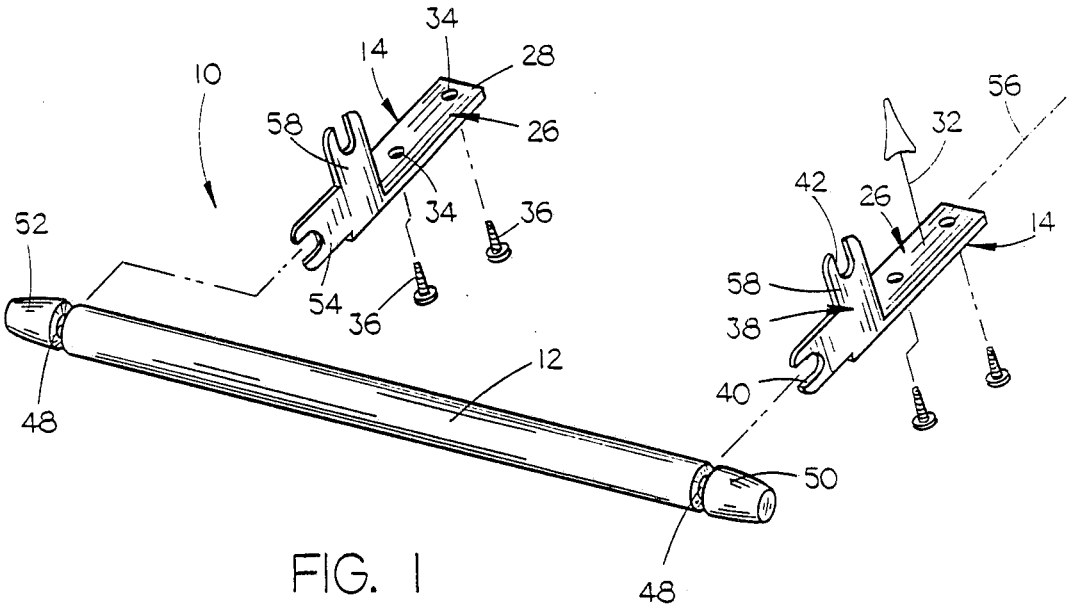
FIG. 1 is a perspective view of the roller attachment of the invention.

The roller attachment 10 of the present invention is shown in the drawings as including an elongated roller 12 adapted to be rotatably supported by a pair of brackets 14.

Figure 2:
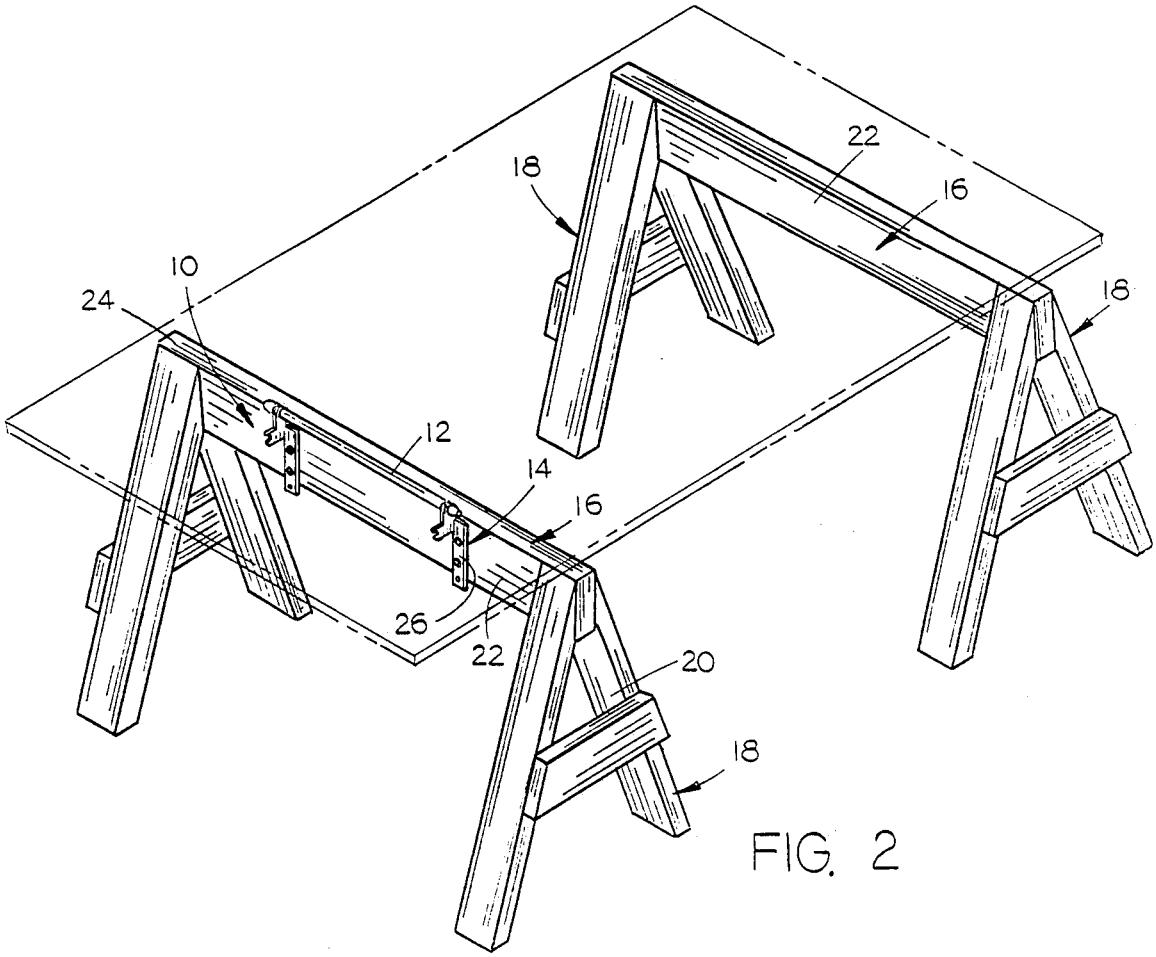
FIG. 2 is a perspective view of a pair of sawhorses having the roller attachment of the invention mounted on one of them with a workpiece shown in dotted lines supported on the sawhorses.

FIG. 2 shows the brackets 14 secured to the top cross bar 16 of a sawhorse 18 which additionally includes a pair of A-frame supports 20 secured to opposite ends of the top cross bar 16.

Because the invention is not limited to use on a sawhorse, the top cross bar 16 will alternately be referred to as a workpiece support member so as to contemplate any structure having a top surface for supporting a workpiece and a vertical edge where the bracket may be positioned for supporting the roller 12.

A 2×4 piece of lumber is commonly used as the top cross bar 16 of a sawhorse 18 but even any other top cross bar is generally rectangular in cross section having opposite long sides 22 and short sides 24. The brackets 14 of the invention are designed to accommodate attachment to the top cross bar 16 whether it is oriented with the long sides disposed upright as in FIG. 3 or horizontally as in FIG. 4.

Each bracket 14 includes an elongated fastening plate 26 having an interior face 28 and an exterior face 30 which are so labeled simply for purposes of description. Accordingly, "interior" refers to a direction perpendicular to the plane of fastening plate 26 in the direction of arrow 32 in FIG. 1 and "exterior" refers to the opposite direction. Each fastening plate is provided with several longitudinally spaced-apart screw holes 34 and accompanying screws 36 for fastening each bracket to a workpiece support member 16. Alternate fastening means such as bolts, rivets, clamps or adhesives could be substituted for the screws and screw holes for particular applications.

In the preferred embodiment, the bracket 14 includes an integrally formed roller support plate 38 bent 90° relative to the fastening plate 26 and having alternate first and second roller supports 40 and 42 positioned interiorly of fastening plate 26 for supporting the roller 12 for rotation about respective first and second axes 44 and 46, as illustrated in FIGS. 3 and 4. Both first and second axes 44 and 46 are extended parallel and transversely of fastening plate 26. The first and second roller supports 40 and 42 are provided as open-ended slots for rotatably receiving reduced diameter portions of roller 12 formed at annular grooves 48 shown in FIG. 1. The opposite end portions 50 and 52 or roller 12 are at least partially tapered to prevent stress and deformation of the workpiece where it engages the ends of the roller.

The roller support plate 38 may be simply formed in an L-shaped including a first leg 54 extended parallel to the longitudinal axis 56 of fastening plate 26 and a second leg 58 extended perpendicularly interiorly from the first leg 54 and fastening plate 26.

Referring to FIG. 3, the first roller support slot 40 is positioned relative to fastening plate 26 for supporting roller 12 with the top 60 of the roller adjacent the plane of the top edge of the workpiece support member 16 upon positioning of the workpiece support member with the long sides 22 upright and upon securement of the fastening plate 26 to an upright long side 22 with the exterior face 30 of fastening plate 26 facing that long side. Similarly referring to FIG. 4, the second roller support slot 40 is positioned relative to fastening plate 26 for supporting the roller 12 with the top 60 of roller 12 adjacent the plane of the top edge of the workpiece support member 16 upon positioning of the workpiece support member with the short sides 24 upright and upon securement of the fastening plate 26 to the long bottom side 22 of the workpiece support member with the interior face 28 facing that long bottom side.

Specific dimensions for bracket 14 are chosen to accommodate attachment to a 2×4 top cross bar 16 as illustrated in the drawings although these dimensions are not critical since similar brackets can be designed to accommodate attachment to a 2×6, 1×4, 1×6, 4×4, or other sizes of rectangle section top cross bars.

Accordingly, the overall length of the bracket may be as little as 4 inches or somewhat longer than 4 inches as is the illustrated bracket. It is desirable to minimize the longitudinal spacing between the roller support slot that is used and the closest screw hole 34 to minimize bending of the fastening plate under the load of a workpiece supported on the roller.

FIGS. 3 and 4 show that the slots are preferably arranged relative to the workpiece so that the top of the roller is slightly above the top edge of the cross bar 16 with the result that a workpiece overlying the top cross bar 16 is supported on the roller 12 for rolling movment relative to the top cross bar. Thus, a workman need only elevate one end of a workpiece from the solid line position to the dotted line position in FIG. 3 out of engagement with one sawhorse to easily roll the workpiece longitudinally of the other sawhorse without any danger of tipping over the other sawhorse or scratching the underside of the workpiece. The roller could alternately be positioned with its top edge in the same plane as the top cross bar or slightly below it and enable to same type of adjustment of the workpiece by simply requiring that the free end be lifted somewhat higher to be sure that the other end of the workpiece adjacent the roller is raised out of engagement with the top cross bar 16. It is important that the bracket itself terminate short of or below the top edge of the workpiece support member so that the sawhorse can be used in conventional fashion without a roller upon removal of the roller from the brackets. Thus the brackets themselves will not engage or scratch a workpiece supported on the sawhorse.

Whereas the invention has been shown and described in connection with a preferred embodiment thereof, it is apparent that many modifications, substitutions and additions may be made which are within the intended broad scope of the appended claims. For example, whereas the roller supports are illustrated as open topped slots, these could be replaced with cup-like sleeves for rotatably receiving reduced diameter ends of a roller. Likewise, the roller support plate 38 need not be integrally formed with the fastening plate 26 although that is a simple economical construction.

For materials, the roller may be formed of cold-rolled steel and the brackets are preferably formed from stainless steel straps with the slots milled out.

The roller attachment of the invention thus may be quickly and easily installed on any conventional sawhorse regardless of the orientation or particular size of the top cross bar thereof. The attachment lends itself to inexpensive manufacture so as to be available for widespread use. In operation, a large heavy workpiece can be easily manipulated and repositioned on a pair of sawhorses by a single worker without tipping over one sawhorse or dragging and possibly scratching the workpiece on the one sawhorse. Whereas the second leg of the bracket must be designed to accommodate a particular thickness of a workpiece support member, the length of the first leg 54 is not critical since the entire bracket can be vertically adjusted to accommodate attachment to a workpiece support structure of almost any size.

Thus there has been shown and described an improved roller attachment which accomplishes at least all of the stated objects.

I claim:

1. A roller attachment for a workpiece support member which is generally rectangular in cross section, having opposite long and short sides, comprising, an elongated roller, bracket means for rotatably supporting said roller on said workpiece support member, said bracket means including an elongated fastening plate having an interior face and an exterior face and alternate first and second roller support means positioned interiorly of said fastening plate for supporting said roller for rotation about respective first and second axes extended parallel to and transversely of said fastening plate, and fastening means for securing said fastening plate to a workpiece support member, said first roller support being arranged relative to said fastening plate for supporting said roller with the top of the roller adjacent the plane of the top edge of the workpiece support member upon positioning of the workpiece support member with the long sides upright and upon securement of said fastening plate to an upright long side with said exterior face facing said long side, and said second roller support means being arranged relative to said fastening plate for supporting said roller with the top of the roller adjacent the plane of the top edge of the workpiece support member upon positioning of the workpiece support member with the short sides upright and upon securement of said fastening plate to the long bottom side of the workpiece support member with said interior face facing said long bottom side whereby a workpiece overlying said workpiece support member may be supported on said roller for rolling movement relative to said workpiece support member.

2. The roller attachment of claim 1 wherein said bracket means comprising a pair of brackets for supporting opposite ends of said roller.

3. The roller attachment of claim 1 wherein said bracket means further comprises a roller support plate secured to said fastening plate and extended perpendicularly interiorly thereof, said roller support means being positioned on said roller support plate.

4. The roller attachment of claim 3 wherein said roller support plate is integrally formed with said fastening plate and bent ninety degrees relative thereto.

5. The roller attachment of claim 3 wherein said first and second roller support means comprise a pair of open ended slots in said roller support plate.

6. The roller attachment of claim 4 wherein said roller support plate is generally L-shaped including a first leg extended parallel to the longitudinal axis of said fastening plate and a second leg extended perpendicularly interiorly thereof.

7. The roller attachment of claim 5 wherein said roller comprises a pair of annular grooves adjacent opposite ends thereof defining reduced diameter roller portions adapted for receipt within said open ended slots.

8. The roller attachment of claim 7 wherein said roller further comprises tapered end portions.

9. The roller attachment of claim 1 wherein said fastening means comprises a plurality of screw holes through said fastening plate and screws insertable through said screw holes.

10. The roller attachment of claim 1 wherein said workplace support member comprises the top cross bar of a sawhorse.

* * * * *